United States Patent [19]

Birse et al.

[11] Patent Number: 4,685,396

[45] Date of Patent: Aug. 11, 1987

[54] METHOD AND APPARATUS FOR SAFER REMOTELY CONTROLLED FIRING OF IGNITION ELEMENTS

[75] Inventors: Alan D. Birse, Glasgow; Alan G. King, Ayrshire, both of Scotland

[73] Assignee: Imperial Chemical Industries PLC, London, England

[21] Appl. No.: 767,918

[22] Filed: Aug. 21, 1985

[30] Foreign Application Priority Data

Sep. 4, 1984 [GB] United Kingdom ..... 8422323

[51] Int. Cl.[4] ..... F42C 11/06

[52] U.S. Cl. ..... 102/206; 102/200; 102/218

[58] Field of Search ..... 102/206, 215, 217, 218, 102/219, 220, 200, 311; 361/248, 251

[56] References Cited

U.S. PATENT DOCUMENTS

| | | | |
|---|---|---|---|
| 3,170,399 | 2/1965 | Hinman, Jr. | 102/219 |
| 3,171,063 | 2/1965 | Hutchison et al. | 102/206 |
| 3,780,654 | 12/1973 | Shimizu et al. | 102/215 |
| 3,834,310 | 9/1974 | Ueda et al. | 102/220 |
| 4,145,970 | 3/1979 | Hedberg et al. | 102/206 |
| 4,445,434 | 5/1984 | Brede et al. | 102/206 |
| 4,487,125 | 12/1984 | Zuk | 102/220 |

FOREIGN PATENT DOCUMENTS

| | | |
|---|---|---|
| 2015791 | 6/1982 | United Kingdom . |
| 2020119 | 6/1982 | United Kingdom . |

*Primary Examiner*—Charles T. Jordan

*Attorney, Agent, or Firm*—Cushman, Darby & Cushman

[57] ABSTRACT

Low level remotely generated control signals are amplified at a local ignition site using a local power source and the amplified control signals are used to charge a local energy storage device. Thereafter firing control signals (e.g., controlled duration suppressions of the remotely generated control signals) are detected and used to control discharge of the thus stored energy through an electrical ignition device.

37 Claims, 7 Drawing Figures

Fig. 1.
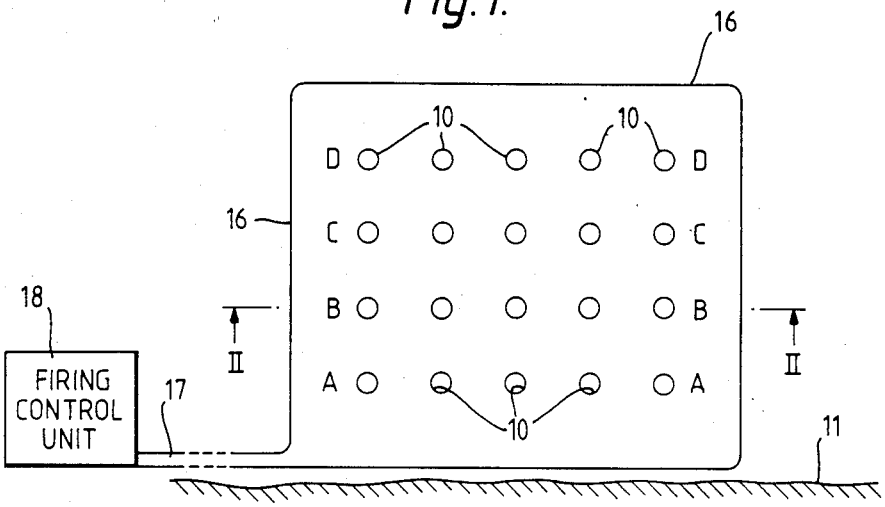
Fig. 2.
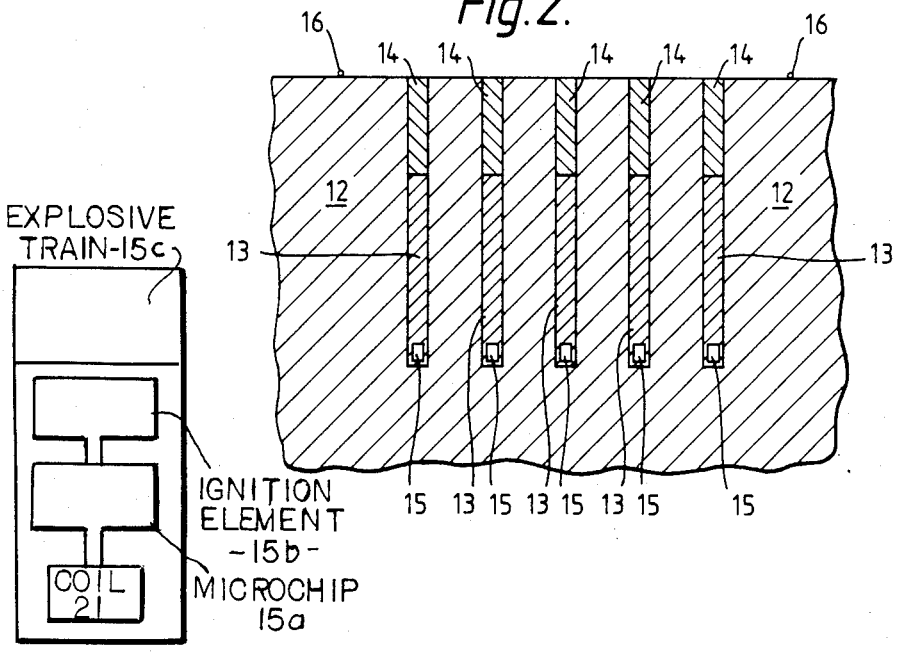
FIG 2A

METHOD AND APPARATUS FOR SAFER REMOTELY CONTROLLED FIRING OF IGNITION ELEMENTS

This invention generally relates to the firing of ignition elements by means of remotely generated control signals. More particularly the invention relates to remote control firing systems wherein there is no fixed signal transmission line such as wire or explosive fusecord over at least part of the distance between the control site and the ignition elements. The invention is especially applicable to the firing of ignition devices in blasting detonators used to detonate blasting explosives in rock blasting operations.

In firing systems of the kind to which the present invention relates, various kinds of signals have been used to effect the required remote control. For example radio frequency, infrared, induction, ultrasonic, laser and pressure (shock) wave signals have been employed, the systems used falling broadly into two categories:

(a) those wherein the firing energy to initiate the device is transmitted; and (b) those wherein only information signals are transmitted, substantially all the firing energy being supplied from a local energy source at the site of the ignition element.

Energy transmitting systems (category a) as described for example in U.S. Pat. Nos. 3,834,310 and 3,170,399 require very powerful, expensive transmitters for even a small number of explosive charges due to their low efficiency of energy transmission. Nevertheless these systems have hitherto been preferred because of the inherent risk that the local energy source in the alternative systems (category b) may cause accidental explosions. This risk is often present even in systems wherein the local energy source is a low voltage source used to charge a capacitor which then supplies the firing energy (e.g., as in the case wherein the local energy source maintains the capacitor in a charged state). Thus, in a system such as is described in U.S. Pat. No. 3,780,654 wherein a first remotely transmitted ultrasonic signal operates a switch to charge a capacitor and a second ultrasonic signal operates a second switch to discharge the capacitor through an ignition element, failure of the second signal leaves the system in an "armed" condition for an indefinite period, because the capacitor charge will not be dissipated until the power source is exhausted.

The present invention provides a safer method for the remotely controlled firing of ignition elements using a local energy source.

This object is achieved by the present invention which provides a firing system wherein a low level energy control signal is transmitted to a receiver at the site of the ignition element and where the received signal is then amplified by means of an amplifier powered by a local energy source and fed to an energy storage means such as a capacitor. A firing control signal (or signals) is then transmitted to the receiver and used to operate a switch to discharge the energy storage means through the ignition element. The firing control signal may be a signal carried by the low energy control signal itself and may, for example, be a variation in frequency or interruption of the low energy control signal.

The invention ensures that the energy storage means cannot remain in a charged condition in the event of any failure in the transmission or reception of the control signals because, should the energy control signals cease before firing of the ignition element, there will be no continued amplified energy input to the energy storage means and the charge will therefore soon be dissipated (either by internal leakage or, if desired, by auxiliary energy dissipation means, such as a current sink, which may be included in the system). Similarly, if the ignition element is not fired in reasonable time, the charge will naturally drain away from the energy storage means when the transmission of the low energy control signal is stopped.

Thus, in accordance with the present invention, a method of firing an electric ignition element at an ignition site from a control site remote from said ignition site comprises:

generating at said remote site a low energy control signal;

transmitting said low energy control signal from the remote site and receiving said low energy control signal at the site of the ignition element, the received low energy control signal itself being incapable of firing the ignition element;

amplifying the received low energy control signal in amplifying means powered form a power source adjacent to the ignition element to provide an amplified energy signal;

feeding the amplified energy signal to energy storage means whereby said energy storage means is charged with sufficient energy for firing said ignition element;

thereafter generating at said remote site at least one characteristic firing control signal;

transmitting said firing control signal(s) to firing control means at the site of the ignition element whereby at least one characteristic control signal is identified and, in response thereto, discharging said energy storage means through said ignition element.

Further in accordance with the invention apparatus for electrically igniting an ignition element from a local energy source using remotely generated control signals comprises:

a local power source;

signal receiving means for receiving said remotely generated control signals;

signal amplifier means powered by said local power source and connected to amplify said control signals;

energy storage means connected to receive said amplified control signals and to store electrical energy derived therefrom; and local firing control means comprising means to detect a predetermined characteristic of said received control signals as fire control signals and, in response to such detection, to discharge stored electrical energy from the energy storage means through an electrically ignitable ignition element.

The invention also includes an ignition assembly comprising the aforedescribed apparatus with an ignition element connected thereto to receive electrical energy from energy storage means.

The firing control means may comprise signal discriminator means also connected to said signal receiving means for identifying control signals; and switch means responsive to said discriminator means for discharging said energy storage means through said ignition element in response to identification of at least one characteristic firing control signal.

The firing control signal or signals may advantageously be generated by modifying the low energy control signal. For example, the low energy control signal may be in the form of a periodic wave of predetermined frequency which is controllably interrupted or modified for predetermined durations to generate the firing control signals. The signal discriminator means then advantageously includes pulse length discriminator means for detecting modified segments of predetermined duration in the received control signals as the firing control signals. Suitable signal generators and signal discriminators are per se known and used in systems for firing blasting detonators. A signal generator and a pulse length discriminator suitable for use in the present invention has been described in British Patent Specification No. 2,015,791B. In a typical system of the invention a low energy control signal is transmitted at about 20 kHz and the firing control signals are generated by interrupting the low energy control signal for one or more cycles. The signal discriminator will then be preset to respond to an interruption of a length within predetermined limits. Typically the interruption may be in the range of 100 to 200 microseconds. The signal discriminator may be preset to respond to the first firing control signal or it may include counting means to enable it to respond as required to a plurality of firing control signals individually or in sequence.

The signal discriminator preferably comprises further means to detect the absence of low energy control signals, failure to receive a predetermined number of normal firing control signals, or failure to fire the ignition element within a predetermined time, and in any of these circumstances, to effect dissipation of the charge from the energy storage means.

The switch means conveniently comprises logic circuitry incorporating switching transistors arranged to conduct current to the ignition element on receipt of appropriate inputs from the signal discriminator means.

The power source is conveniently a low voltage, typically 6–18 volt, electric battery and the storage means is conveniently a capacitor. Preferably the internal impedance of the power source is sufficiently high to prevent firing of the ignition element in the event of the ignition element being accidentally connected directly across the power source. Since the energy signal from the amplifier will, in the preferred embodiments of the system, be an A.C. energy signal, the energy signal will usually be rectified before being fed to the capacitor and for this purpose a rectifier is conveniently included in the amplifier output to the energy storage means. The output from the amplifier is preferably coupled to the energy storage means through an element that does not pass D.C. currents (e.g., a capacitor or transformer) in order to avoid any risk of the storage means receiving any current directly from the power source.

The amplifier means may be a single-stage amplifier but preferably it is a multi-stage frequency bandpass amplifier. Thus a preferred amplifier system comprises a first amplifier giving normal amplification of the received low energy signal, a second amplifier having associated bandpass filters for rejecting spurious low frequency signals such as power (50–60 $H_z$) frequency signals, and high frequency signals such as radio frequency signals of more than 200 kHz, and a third amplifier for amplifying the energy signal to saturation level giving the maximum output voltage which can be obtained from the power source.

The ignition element may conveniently be any electrically operated ignition element. Thus the invention may advantageously be used for firing an electric fusehead of the kind used in a blasting detonator to initiate a detonation train, the detonator being operative as required to detonate one or more further explosive charges. The ignition element may be an instantaneous fusehead which fires an associated charge of incendiary material immediately on discharging sufficient current through it from the energy storage means. However, in many uses of ignition elements, for example in rock-blasting, a plurality of ignition elements and associated charge are required to be ignited in time delay sequence. When using the ignition method of the present invention the required delay may be provided as appropriate for each ignition element by including a pyrotechnic delay element after the ignition element in the ignition train. However the required delay may advantageously more accurately be obtained by means of electronic time delay means connected in the ignition assembly and arranged to operate the switch means to fire the ignition element at a predetermined time after a predetermined control signal is identified by the discriminator as a delay time starting control signal.

A preferred electronic time delay means includes a time delay circuit as described in British Patent Specification No. 2,015,791B, which circuit permits the delay period of each ignition element or group of ignition elements to be set by means of the remotely generated characteristic firing control signals. The circuit includes an internal oscillator generating clock pulses and an internal electronic counter for counting the clock pulses. The counter is arranged to start counting clock pulses when a first characteristic firing control signal is identified in the signal discriminator and to stop counting when a second characteristic firing control signal is identified. The clock pulse count is stored for a predetermined number of clock pulses, which may be zero, the signal discriminator means identifies a delay time starting control signal, which conveniently may be the second characteristic firing control signal, and the switch means is operated to fire the ignition element after a further number of clock pulses which is a function of the stored count. Sequential firing of a series of ignition elements is effected by transmitting a timed series of firing control signals to the ignition elements, the signal discriminator means of each ignition element being arranged to count the firing control signals and to identify predetermined signals of said timed series as the first and second characteristic firing control signals for that particular ignition element.

Conveniently the second characteristic firing control signal is the same for all ignition elements in the sequence and the ignition elements will fire in the reversed order of the first characteristic firing control signals. The time delay means may be energized from the charge storage means, the amplifier output or directly from the power source.

In the ignition assembly of the invention the amplifying means, the signal discriminator means, the delay timing means, if required, and the switch means may be included in an integrated circuit formed on a microchip which conveniently may be encapsulated with the ignition element and explosive train in the casing of a blasting detonator. The invention may advantageously be operated with a wide variety of signals which can be transmitted without conventional transmission connections such as conductor wires or pyrotechnic transmission lines. Thus the signal generating and transmitting means may comprise means for generating and transmitting (a) radio frequency, (b) infrared, (c) electromagnetic induction (d) ultrasonic, (e) laser or (f) pressure (shock) wave signals.

However in the preferred system an electric signal is transmitted by electromagnetic induction using a wire inductive loop as the transmitter and an induction pick-up coil as the signal receiving means. In operation a high frequency electric signal, typically about 20 kHz, is passed from a generator through the induction loop and is received in the pick-up coil at the ignition site. The system using induction signals is especially advantageous in rock blasting operations such as blasting in quarries, because the receiving means does not need to be exposed at the mouth of a shothole, whereas systems using radio frequency, infrared, ultrasonic or laser signals generally require the receiver to be outside the shothole. The receiver can therefore be positioned deep within the shothole at the position preferred for the ignition element.

Moreover, the system using inductive signals is free from certain disadvantages inherent in some of the other systems. Thus pressure waves are more susceptible to interference from ground faults or other ground discontinuities; ultrasonic and pressure waves have low transmission velocity which causes difficulty in obtaining accurately controlled relative firing times of ignition elements fired in sequence; and the generating and transmitting equipment required for laser signals is much more expensive.

The invention is further illustrated by the presently preferred embodiment which is hereinafter described, by way of example, in detail with reference to the accompanying drawings wherein FIG. 1 is a diagrammatic plan view of an array of shotholes and a signal transmitter at a blasting site;

FIG. 2 is a sectional elevation of the shothole array taken on the line 2—2 of FIG. 1;

FIG. 2A is a schematic block diagram of the ignition assembly;

Figure 3:
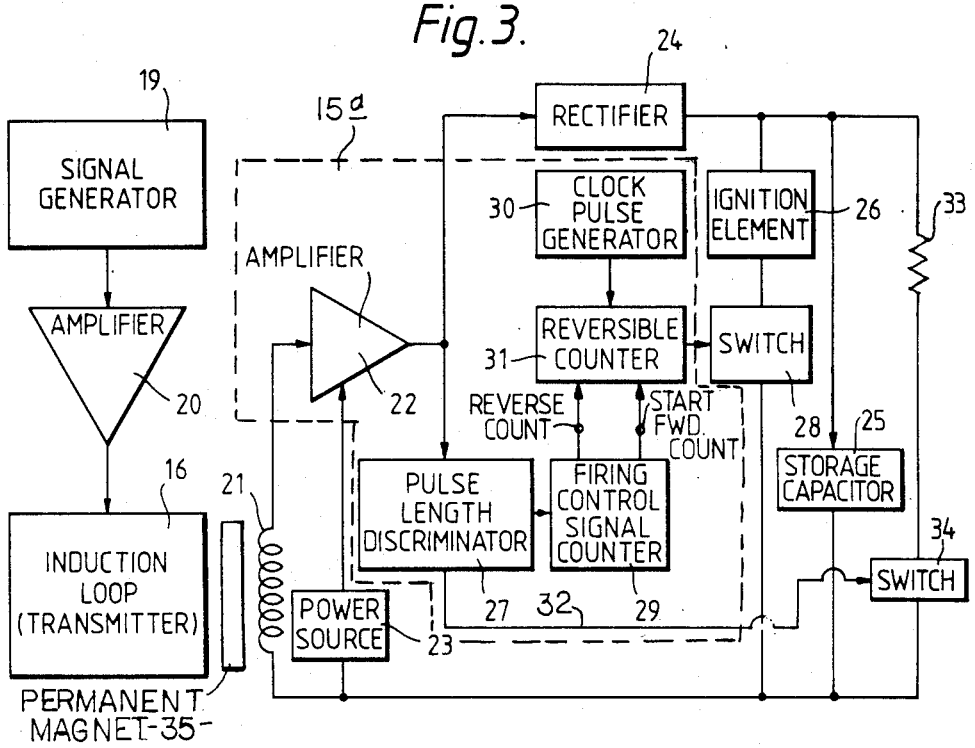
FIG. 3 is schematic block diagram of the firing system for a time delay ignition.

In FIGS. 1 and 2 of the drawings there is shown diagrammatically, not to scale, an array of shotholes 10 drilled adjacent to a free face 11 in a rock mass 12, the shothole spread being appropriate for blasting the rock by the detonation of blasting explosive charges 13 which are loaded into the shotholes and covered with stemming material 14. In each shothole 10, at the bottom of each explosive charge 13, is an ignition assembly 15 of the invention, the ignition element of the assembly 15 being an electric fusehead of a blasting detonator in position to detonate the explosive charge. A loop 16 of wire serving as an induction loop and transmitting the control signals is located on the top surface of the rock so as to surround the shotholes 10 but not to overlie any shothole. The induction loop 16 is connected by a long firing cable 17 to a firing control unit (FCU) 18. When the appropriate control signals are generated in FCU 18 and fed through the induction loop 16, the signals transmitted by the induction loop 16 are picked up by an induction pick-up coil 21 (FIG. 3) in each of the assemblies 15 and the fuseheads in the assemblies ignite and cause detonation of the explosive charges 13. As illustrated in FIG. 2A, ignition assembly 15 encases explosive train **15*c*, ignition element 15*b* and a microchip 15*a* to process signals generated on pick-up coil 21. The shot holes 10** are disposed in rows designated as A, B, C and D respectively and, in order to reduce ground vibration, the ignition assemblies in each row are arranged to fire consecutively with a preselected time delay between the firing time of the assemblies in the rows.

The arrangement of the components of the firing system are shown in greater detail in FIG. 3. The F.C.U. 18 is the remote firing control unit from which the blasting operation is controlled. The F.C.U. 18 includes a signal generator 19, whereby energy control signals at high frequency, typically 20 kHz, and firing control signals are generated, and a power driven amplifier 20 for amplifying the energy control signals supplied to the induction loop 16. The firing control signals may be generated merely by interrupting the high frequency energy signal briefly at precisely timed intervals.

The ignition assembly 15 has a pick-up coil 21 to receive the signal transmitted from the induction loop 16. The pick-up coil 21 is connected to feed the received signal to a multistage amplifier 22 (shown in detail in FIG. 6) which is powered by an electric battery 23 (preferably having sufficient internal impedance to avoid firing the ignition element 26 even if directly connected thereacross). The output signal from the amplifier 22 is fed through a half-wave rectifier 24 to a storage capacitor 25 which stores sufficient energy to fire an associated ignition element 26. The output signal from amplifier 22 is also fed to a pulse length discriminator 27 wherein signals formed by interruptions of the energy signal (having a duration within predetermined limits) are identified as the characteristic firing control signals and used to operate a switch 28 to discharge firing energy from the capacitor 25 through the ignition element 26. Instantaneous ignition elements, which are not intended for use in conjunction with any delay ignition elements need only have a simple discriminator 27. However, where the ignition element is to be used as part of a sequence of ignition elements firing in a predetermined time sequence (as in the blasting operation illustrated in FIGS. 1 and 2), the discriminator preferably feeds an associated firing control signal counter 29.

The pulse length discriminator 27 may also be arranged to detect the absence of energy control signals, failure to receive a predetermined number of normal firing control signals after having started to receive same or failure to fire the ignition element within a predetermined time, and to provide an output 32 in response to any such detected inappropriate circumstance. Suitable energy dissipator, e.g., a resistor 33 may be switched across the storage capacitor 25 by switch 34 in response to such a control signal 32.

For firing the ignition element 26, a timed sequence of firing control signals 1, 2, 3 . . . is transmitted and counted in counter 29. Counter 29 is pre-set for each ignition element to respond to one or more particular (characteristic) numbers of firing control signals either to operate the switch 28 to fire the ignition element immediately on receipt of a particular number, or to effect firing of the ignition element 26 at a predetermined time after receipt of the particular numbers of signals.

Firing of a series of ignition elements in time delay sequence is achieved by means of a clock pulse generator 30 and a reversible counter 31 wherein the clock pulses from generator 30 are counted. Reversible counter 31 is connected to the firing control signal counter 29 and is arranged to start a forward count of clock pulses on receipt of a first characteristic firing control signal to which counter 29 is pre-set to respond. On receipt of a second characteristic firing control signal (to which counter 29 is also pre-set to respond) reversible counter 31 reverses and starts counting the clock pulses backwards (i.e., the counter contents are decremented). When the count in counter 31 again reaches the starting count, counter 31 is pre-set to operate switch 28 and thus to fire ignition elment 26. By identifying different firing control signals as the "first" characteristic control signals for a series of ignition elements (e.g., by differently presetting counter 29 in each row) and identifying the same firing control signal as the "second" characteristic firing control signal (in each row), the ignition elements will be fired in the reverse order of the individually identified "first" characteristic firing control signals. Thus in the blasting operation illustrated in FIGS. 1 and 2 the rows of charges A, B, C and D may be fired in sequence with, for example, 25 millisecond delay between the firing of the rows, by first transmitting low energy control signals to charge the capacitor 25 in each ignition assembly and then successively generating four firing control signals 1, 2, 3 and 4 at 25 millisecond intervals in the FCU. Signal counters 29 in the ignition assemblies of rows B, C and D are pre-set to identify signals 3, 2 and 1 respectively as the "first" characteristic firing control signals (thus starting the forward count in counter 31 at different times in the different rows) and signal 4 as the "second" characteristic firing control signal (thus reversing the count in counter 31 at a common time in all rows). The ignition assemblies in row A are pre-set to fire instantaneously when firing control signal 4 is identified by counter 29. (These assemblies for row A thus do not really require a clock pulse generator 30 or counter 31.) On receipt of signal 4 the charges in row A will fire, followed by those in rows B, C and D at 25 millisecond intervals. It will be understood that the time delay intervals between the firing of consecutive ignition elements need not be exactly the same as the intervals between the generated control signals, as in the aforedescribed example, but may, for example, be a multiple of the intervals of the generated control signals.

Amplifier 22, pulse length discriminator 27 and a time delay means including at least firing control signal counter 29, reversible counter 31 and clock pulse generator 30 may be formed on microchip 15*a*.

Optionally, an additional output 32 may be taken from the pulse-length discriminator 27 and used to operate a safety circuit (e.g., dissipator 33 and switch 34) to discharge the capacitor 25 when the duration of an interruption in the energy signals from the amplifier exceeds a predetermined limit.

As a further optional safety feature, an auxiliary static magnetic field (e.g., via a locally placed permanent magnet 35) may be provided around the pick-up coil 21 in order to reduce the sensitivity of the ignition assembly to inductive fields. This renders the ignition assembly inoperable even with the power source connected in the circuit. Also, by varying the intensity of the magnetic field (e.g., by varying the size or location of the magnet) the sensitivity (gain) of the ignition assembly can be controlled. The magnetic field is particularly effective if the pick-up coil comprises a ferrite core.

Figure 4:
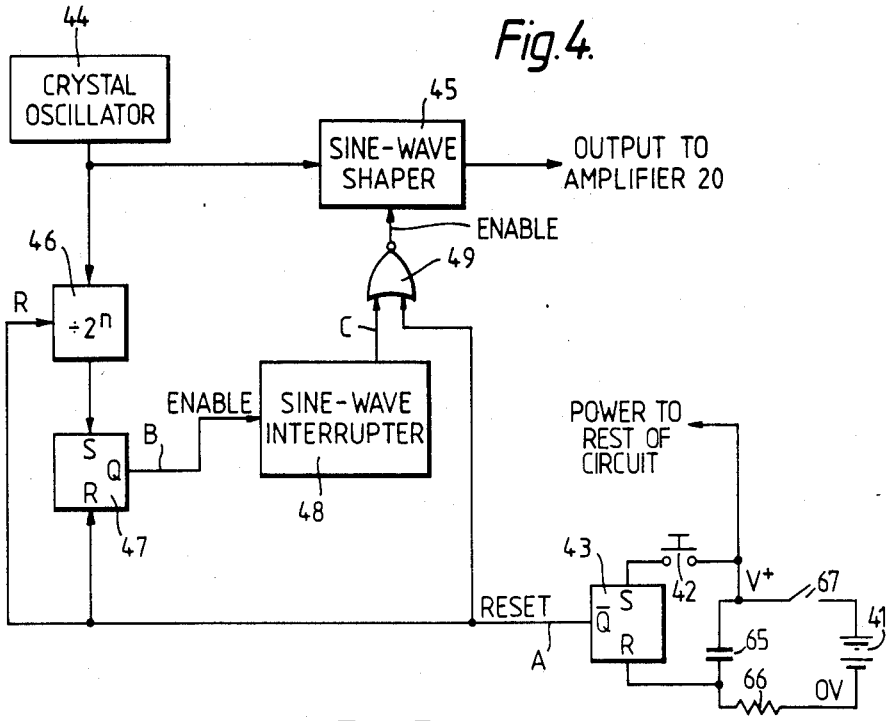
FIG. 4 is a more detailed schematic block diagram of the signal generator of the firing system of FIG. 3.

A suitable form of signal generator 19 for supplying energy control signals and firing control signals is shown in more detail at FIG. 4. The generator 19 comprises a power supply 41, capacitor 65, resistor 66, switch 67, start switch 42, flip-flop 43, reset line A (e.g. carrying the Q output of flip-flop 43) and a crystal oscillator 44 generating clock pulses. The oscillator 44 output is fed through a sine-wave shaper 45 (e.g., a passive tuned circuit with gated output control) wherein it is shaped to the form of a continuous sine-wave of a constant frequency, for example 20 kHz. (Alternatively, oscillator 44 might itself generate a sinusoidal waveform and shaper 45 might be replaced with a suitable controlled gate ) The output signal is controlled by a $\div 2^n$ counter 46 to last for a sufficient period to ensure full charging of the energy storage capacitors 25 in all the ignition assemblies to be fired. This period will depend on the components in the firing system but will usually not be longer than 10 seconds.

The energy control signals are thereafter interrupted to provide firing control signals by means of a flip-flop 47, an interrupter control circuit 48 and NOR gate 49. In operation, when switch 67 is closed, capacitor 65 is charged through resistor 66, and a power-on reset is applied to flip-flop 43, thereby activating reset line A and resetting the $\div 2^n$ counter 46 and disabling the sine-wave interrupter 48 (via reset flip-flop 47) and the sine-wave shaper 45 (via NOR gate 49).

Figure 5:
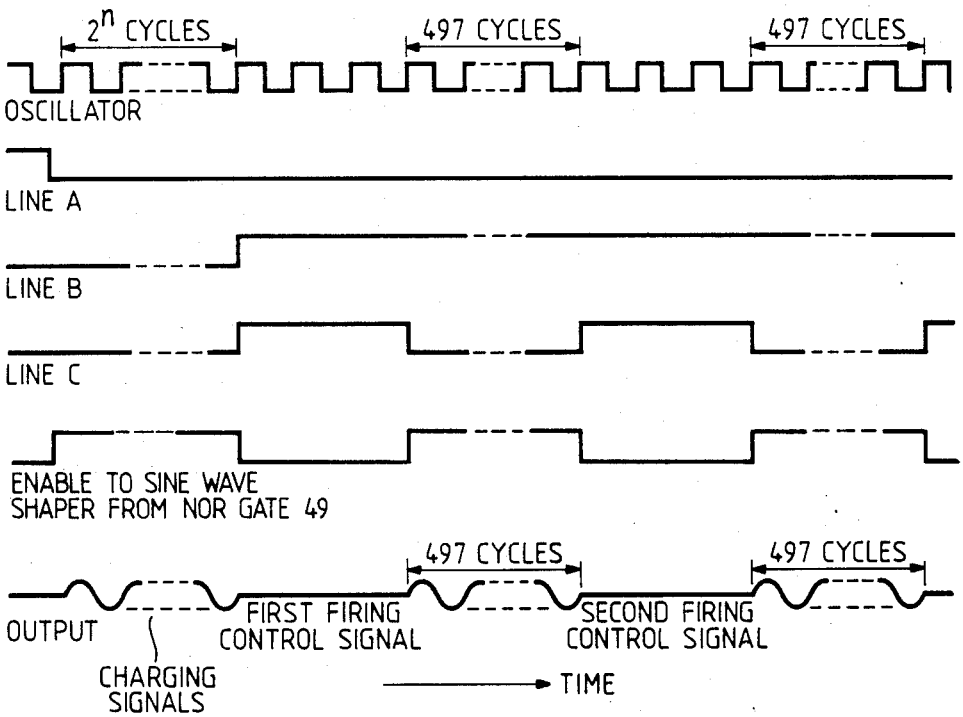
FIG. 5 is a signal time diagram showing the wave form at various positions of the generator of FIG. 4.

When the start switch 42 is operated, it sets flip-flop 43 and the reset line A is thereby released allowing the $\div 2^n$ counter 46 to operate and enabling the sine-wave shaper 45 to begin operations. When counter 46 has counted sufficient pulses to ensure that each storage capacitor 25 is charged (for example for a charging time of 10 seconds at a frequency of 20 kHz, counter 46 is set to count $2^{18}$ pulses and then to provide an output pulse) it sets flip-flop 47 which, in turn, enables the sine-wave interrupter control 48. The interrupter 48 may be of conventional design and is arranged to disable the sine-wave shaper 45 for an accurately determined period at regularly spaced intervals. Thus, in order to provide firing control signals at intervals of 25 milliseconds from a 20 kHz energy signal, an output controlling gate in the sine-wave shaper 45 is disabled for a short period every 500 cycles. The length of the interruption need be no more than about 3 cycles to ensure reliable detection by a receiver. The form of the signal from the oscillator 44, the signals through lines A, B, C and the output of FIG. 4 is shown in FIG. 5 for a signal generator producing at its output an initial energy control signal and subsequent firing control signals at 25 millisecond intervals.

Figure 6:
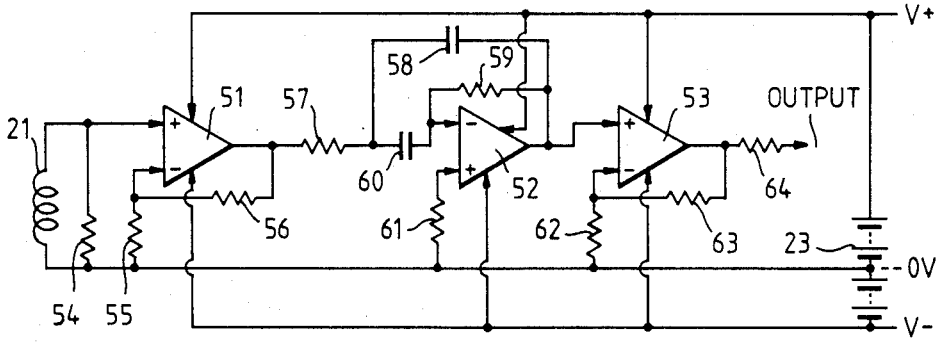
FIG. 6 is a schematic circuit diagram of the receiving circuit amplifier of FIG. 3.

The circuit of one suitable multi-stage amplifier 22 is shown in greater detail in FIG. 6. Amplifier 22 comprises three amplifying stages, the stages having operational amplifiers depicted as 51, 52 and 53 respectively. Amplifier 51 gives normal amplification of the low energy control signal received in pick-up coil 21 which is connected to amplifier 51 in parallel with a load resistor 54. Negative feedback is applied in conventional manner to the inverting input of amplifier 51 from the output of amplifier 51 via resistors 55 and 56, the ratio of the value of the resistors controlling the gain of the amplifier 51. The output of amplifier 51 is fed to a band-pass filter, which comprises a high frequency blocking filter consisting of a resistor 57 and a capacitor 58, and a low frequency blocking filter consisting of a resistor 59 and a capacitor 60, both filters having gain provided by amplifier 52. As should be appreciated, the cut-off frequencies for these filters will be chosen so as to leave passage only for the 20 kHz energy/control signals in the exemplary embodiment. Amplifier 52 is used as an inverting amplifier with its non-inverting input connected to ground through a resistor 61. The output from the bandpass filter is connected to the non-inverting input of amplifier 53. Negative feedback is applied in conventional manner to the inverting input of amplifier 53 from the output of amplifier 53 via resistors 62 and 63, the ratio of the values of these resistors controlling the gain of amplifier 53. The gain of amplifier 53 is made sufficiently large to saturate the output. Thus the output is only limited in amplitude by the size of the power supply 23. The output from the amplifier 53 is connected to the pulse length discriminator 27 and rectifier 24 (FIG. 3) through a resistor 64 which provides an output impedance limiting the output current. All of the amplifiers 51, 52 and 53 are powered by a split power supply 23. The pulse length discriminator 27, counter 29, local clock pulse generator 30, reversible counter 31 and switch 28 are well known components of electronic timing circuits. Such components and circuits may be, for example, those described in British Patent Specification No. 2,015,791 B for an electric delay device.

It will be apparent that the components of the firing system will be chosen to provide the requirements of a particular system. However for firing conventional electric fusehead ignition elements in blasting detonators in a blasting operation as illustrated in FIGS. 1 and 2 wherein the shotholes are 10 to 15 meters deep, the components may be as follows:

Crystal oscillator 44—a CMOS integrated circuit oscillator (CD 4047)

Induction loop 16—10×12 meter loop of PVC insulated 23 gauge (0.61 mm) tinned copper wire.

Pick-up coil 21—Telephone pick-up coil TC 211 made by Altai

Amplifiers 51,52,53—LF347 QUAD operational amplifiers

Resistor 54—100 K Ω

Resistor 64—100 Ω

Resistor 55—1 K Ω

Resistor 56—270 K Ω

Resistors 57,59,61&62—10 K Ω

Resistor 63—1M Ω

Capacitors 58&60—680pF

Power source 23—4×9V PP3 batteries

Storage capacitor 25—100μF 25V

Although only one exemplary embodiment of the invention has been described in detail, those skilled in the art will appreciate that many modifications and variations may be made in this embodiment while yet retaining many of the advantageous novel features of this invention. Accordingly, all such modifications and variations are intended to be included within the scope of the following claims.

We claim:

1. A method for firing an electric ignition element from a remote control site, said method comprising:

generating at said remote site an energy control signal;

transmitting said energy control signal from said remote control site and receiving said energy control signal at the site of the ignition element, the received energy control signal being of sufficiently low energy as to be incapable of directly firing the ignition element;

amplifying the received energy control signal in amplifying means powered from a local power source located adjacent to the ignition element to provide an amplified local energy signal;

feeding the amplified energy signal to local energy storage means whereby said energy storage means is charged with sufficient energy for firing said ignition element;

thereafter generating at said remote site at least one characteristic firing control signal;

transmitting said firing control signal(s) to firing control means located at the site of the ignition element whereby at least one characteristic firing control signal is identified and, in response to said identification, discharging said energy storage means through said ignition element.

2. A method as claimed in claim 1 wherein said firing control signal is generated by modifying a predetermined characteristic of the said energy control signal.

3. A method as claimed in claim 1 or claim 2 wherein the energy control signal is in the form of a periodic wave of predetermined frequency which is controllably interrupted or modified for predetermined durations at predetermined intervals to generate firing control signals.

4. A method as claimed in claim 3 wherein a cycle modification or interruption of said energy control signal having a duration within a predetermined range is identified as a firing control signal by means of a pulse length discriminator.

5. A method as claimed in claim 1 or 2 wherein the absence of energy control signals after earlier receipt of same, failure to receive a predetermined number of normal firing control signals or failure to fire the ignition element within a predetermined time is detected by the signal discriminator means and dissipation of the charge from the energy storage means is consequently effected in response to such detection.

6. A method as claimed in claim 1 or 2 wherein the electric ignition element is an electric fusehead.

7. A method as claimed in claim 1 or 2 wherein a plurality of ignition elements are fired in time delay sequence.

8. A method as claimed in claim 1 or 2 wherein a predetermined firing control signal is identified by the firing control means as a delay time starting control signal and the ignition element is fired at a predetermined time after said delay time starting control signal as measured by electronic time delay means.

9. A method as claimed in claim 8 wherein the predetermined time delay is obtained by generating clock pulses in an oscillator and counting the number of clock pulses generated between a first and second characteristic firing control signals, storing the clock pulse count for a predetermined number of clock pulses, which may be zero, identifying a delay time starting signal, and, after a further number of clock pulses which is a function of the stored count, discharging the energy storage means through the ignition element.

10. A method as claimed in claim 9 wherein a series of electric ignition elements is fired sequentially by transmitting a timed series of firing control signals to the ignition elements, and identifying at the site of each ignition element predetermined ones of said time series as the first and second firing control signals for the ignition element located at that site.

11. A method as claimed in claim 10 wherein the second characteristic firing control signals is the same for all ignition elements in the sequence, the ignition elements being fired in the reversed order of the transmission of the respectively identified first characteristic firing control signals.

12. A method as claimed in claim 1 or 2 wherein the energy control signal is an electromagnetic induction signal.

13. A method as claimed in claim 12 wherein an electromagnetic induction signal is transmitted from a wire induction loop to a pick-up coil located within a shothole.

14. Apparatus for electrically igniting an ignition element from a local energy source using remotely generated control signals, said apparatus comprising:

a local power source;

signal receiving means for receiving said remotely generated control signals;

signal amplifier means powered by said local power source and connected to amplify said control signals;

energy storage means connected to receive said amplified control signals and to store electrical energy derived therefrom; and local firing control means comprising means to detect a predetermined characteristic of said received control signals as firing control signals and, in response to such detection, to discharge stored electrical energy from the energy storage means through an electrically ignitable ignition element.

15. Apparatus as claimed in claim 14 wherein the local firing control means comprises:

signal discriminator means connected to receive and identify characteristic firing control signals; and switch means responsive to said discriminator means for discharging said energy storage means through said ignition element in response to identification of at least one characteristic firing control signal.

16. Apparatus as claimed in claim 15 wherein said signal discriminator means includes pulse length discriminator means for detecting modified segments of predetermined duration in the received control signals as said firing control signals.

17. Apparatus as claimed in claim 15 or claim 16 wherein the signal discriminator means includes counting means to enable said signal discriminator means to respond to a plurality of firing control signals individually or in sequence.

18. Apparatus as claimed in claim 15 or 16 wherein the signal discriminator means comprises means to detect the absence of energy control signals, failure to receive a predetermined number of normal firing control signals, or failure to fire the ignition element within a predetermined time, and to effect dissipation of the charge from the energy storage means in any of these circumstances.

19. Apparatus as claimed in claim 15 or 16 wherein the switch means comprises means for conducting current to the ignition element on receipt of appropriate inputs from the signal discriminator means.

20. Apparatus as claimed in claim 15 or 16 comprising electronic time delay means connected to the signal discriminator means and the switch means and arranged to operate the switch means to discharge the energy storage means at a predetermined time after a predetermined firing control signal is identified by the discriminator means.

21. Apparatus as claimed in claim 20 wherein the electronic time delay means comprises:

an oscillator generating clock pulses and an electronic counter for counting the clock pulses, said counter being arranged to start counting clock pulses when a first characteristic firing control signal is identified in the signal discriminator means and to stop counting when a second characteristic firing control signal is identified;

means to store the clock pulses count for a predetermined number of clock pulses;

means to identify a predetermined firing control signal as a delay time starting signal; and means to operate the switch means to fire the ignition element at a further number of clock pulses after the delay time starting signal which further number is a function of the stored clock pulse count.

22. Apparatus as claimed in claim 21 wherein the signal discriminator means is arranged to count firing control signals in a timed series as the first and second firing control signals.

23. Apparatus as claimed in claim 14, 15 or 16 comprising a rectifier connected between the output of the amplifier means and the energy storage means.

24. Apparatus as claimed in claim 14, 15 or 16 wherein the amplifier means is coupled to the energy storage means through a circuit device which does not pass DC currents.

25. Apparatus as claimed in claim 14, 15 or 16 wherein the amplifier means comprises a multi-stage frequency bandpass amplifier.

26. Apparatus as claimed in claim 20 wherein the amplifier mens, the signal discriminator means, and the time delay means are included in an integrated circuit formed on a microchip.

27. Apparatus as claimed in claim 26 wherein the microchip is encapsulated with the ignition element and an explosive train in the casing of a blasting detonator.

28. Apparatus as claimed in claim 14, 15 or 16 wherein an auxiliary magnetic field is provided around the signal receiving means.

29. Apparatus as claimed in claim 14, 15 or 16 wherein the signal receiving means comprises an inductive pick-up coil.

30. Apparatus as claimed in claim 14, 15 or 16 wherein the local power source comprises an electric battery.

31. Apparatus as claimed in claim 30 wherein the local power source has sufficiently high internal impedance to prevent firing of the ignition element in the event of the ignition element being accidentally connected directly across the power source.

32. Apparatus as claimed in claim 14, 15 or 16 further including a remotely situated fire control unit comprising means for generating and transmitting said control signals.

33. Apparatus as claimed in claim 32 wherein said fire control unit means comprises means for generating a periodic wave of predetermined frequency and for controllably interrupting or modifying same for predetermined durations at predetermined intervals to generate said firing control signals.

34. Apparatus as claimed in claim 21 for firing a series of ignition elements, wherein the signal generating and transmitting means is adapted to generate and transmit a timed series of firing control signals and the signal discriminator means of each ignition element is arranged to count the firing control signals and identify predetermined signals of said timed series as the first and second characteristic firing control signals for that particular ignition element.

35. Apparatus as claimed in claim 32 wherein the signal generating and transmitting means is adapted to generate and transmit electromagnetic induction signals.

36. Apparatus as claimed in claim 35 wherein the signal transmitting comprises a wire induction loop.

37. An ignition assembly comprising apparatus as claimed in claim 14, 15 or 16 having an electrically ignitable ignition element connected to said apparatus to receive energy discharged from said energy storage means.

* * * * *